US010092051B2

(12) United States Patent
Fildan et al.

(10) Patent No.: US 10,092,051 B2
(45) Date of Patent: Oct. 9, 2018

(54) THIN GARMENT CLOSURE

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 164 days.

(21) Appl. No.: 15/407,118

(22) Filed: Jan. 16, 2017

(65) Prior Publication Data

US 2017/0164672 A1 Jun. 15, 2017

Related U.S. Application Data

(63) Continuation-in-part of application No. 14/966,483, filed on Dec. 11, 2015, now Pat. No. 9,833,046.

(51) Int. Cl.
*A41F 1/00* (2006.01)
*A44B 11/25* (2006.01)

(52) U.S. Cl.
CPC ..... *A41F 1/006* (2013.01); *A44B 11/2588* (2013.01)

(58) Field of Classification Search
CPC .... A41F 1/006; A41F 1/04; A41F 1/08; A41F 15/002; A41F 3/02; A44B 11/2588; A44B 17/0041; Y10T 24/45675; Y10T 24/45696; Y10T 24/4578; Y10T 24/45864; Y10T 24/3424; Y10T 24/45775; Y10T 24/3416; A41C 3/02
See application file for complete search history.

(56) References Cited

U.S. PATENT DOCUMENTS 302,421 A * 7/1884 Mosier ..... A41B 11/002 24/578.16
635,314 A * 10/1899 German ..... A41F 3/02 2/341
796,414 A * 8/1905 Chayes ..... A41F 3/02 24/319
2,287,308 A * 6/1942 Hill ..... A44B 11/2588 24/316
3,520,033 A * 7/1970 Usuda ..... A44B 11/2588 24/590.1
3,765,062 A * 10/1973 Cruse ..... A44B 11/2596 24/587.12

(Continued)

*Primary Examiner* — Jack W Lavinder
(74) *Attorney, Agent, or Firm* — Kintner IP, LLC; Mary Frances Ludwig

(57) ABSTRACT

A thin garment closure includes a male member with a bar having a ball each end and a female member having a trough shaped to receive the bar. The bar is positionable in the trough when the male and female members are in a substantially transverse orientation, and when one member is rotated so that both members are substantially coplanar the closure is closed. The male member has side arms angled inward and connecting the male exterior side and the bar. The length of the bar is shorter than the length of the male exterior side. The trough of the female member has a concave region to receive each ball of the bar. In an embodiment, the concave region is enlarged toward the center of the closure to accommodate movement of the bar under tension. These features improve the tensile strength of the closure.

19 Claims, 6 Drawing Sheets

(56) References Cited

U.S. PATENT DOCUMENTS

| | | | | | |
|---|---|---|---|---|---|
| 3,836,049 | A * | 9/1974 | Smith | A44B 11/2588 | 24/587.12 |
| 3,979,801 | A * | 9/1976 | Tareau | A41F 1/006 | 24/587.12 |
| 4,000,544 | A * | 1/1977 | Fildan | A41C 3/02 | 24/312 |
| 4,052,774 | A * | 10/1977 | Noda | A44B 11/2588 | 24/587.12 |
| 4,054,972 | A * | 10/1977 | Rowell | A41C 3/02 | 24/698.2 |
| 4,161,806 | A * | 7/1979 | Hennisse | A41F 1/006 | 24/586.11 |
| D274,293 | S * | 6/1984 | Goepfer | D11/212 | |
| 4,502,192 | A * | 3/1985 | Hess | A44B 11/2588 | 24/589.1 |
| 4,524,495 | A * | 6/1985 | Hess | A44B 11/2588 | 24/593.1 |
| 4,578,843 | A * | 4/1986 | Lewis | A44B 11/2596 | 24/319 |
| 5,377,394 | A * | 1/1995 | Fildan | A44B 11/2588 | 24/587.1 |
| 6,859,982 | B1 * | 3/2005 | Carrillo | A44B 11/2588 | 24/310 |
| 2003/0236054 | A1 * | 12/2003 | Chen | A41C 3/02 | 450/82 |
| 2015/0289598 | A1 * | 10/2015 | Hsiung | A44B 11/005 | 128/202.27 |

* cited by examiner

THIN GARMENT CLOSURE

CROSS REFERENCE TO RELATED APPLICATION

This application is a Continuation-In-Part of and claims the filing benefit under 35 U.S.C. § 120 of application Ser. No. 14/966,483, filed 11 Dec. 2015, now U.S. Pat. No. 9,833,046, which claims the filing benefit under 35 U.S.C. § 119(e) of U.S. Provisional Application No. 62/165,851, filed 22 May 2015, both of which are hereby incorporated by reference.

TECHNICAL FIELD

The present invention pertains generally to fasteners, and more particularly to a thin garment closure.

BACKGROUND OF THE INVENTION

U.S. Pat. No. 6,009,604 describes a brassiere front closure which is easily manipulated by inserting a bar of a male member into a trough of a female member when the members are oriented orthogonally, and rotating the members to a coplanar position to lock the closure. U.S. Pat. No. 9,833,046 describes an improved closure including features which permit easier alignment of the members for simplified manipulation. These structural features further enable an extremely thin closure for improved comfort and visual appearance. In addition, a single female closure member accepts various sizes of male closure member, enabling a garment system with readily detachable and interchangeable components.

For a fastener to be suitable for use with interchangeable straps, the fastener must have a high tensile stress rating. While the fastener of U.S. Pat. No. 9,833,046 provides a tensile strength of 20-30 pounds, it is advantageous to increase the tensile strength as it will decrease the likelihood of the fastener becoming inadvertently undone, causing inconvenience and embarrassment to the wearer.

It is an object of the closure provided herein to incorporate features which resist decoupling under tension while maintaining a thin profile, thus providing a closure suitable for use with interchangeable garment components or as a discrete front closure for a brassiere, bikini, or top.

BRIEF SUMMARY OF THE INVENTION

The present invention is directed to a thin garment closure for lingerie, brassieres, swimwear, and the like. The closure includes male and female members which couple by insertion of a bar of the male member into a trough of the female member with the members in a transverse orientation, followed by a rotation of one member to lock the members in a substantially coplanar orientation. The male and female members each have a flat surface which contacts the flat surface of the mating member when the closure is closed, enabling a thin and narrow closure.

In accordance with an embodiment of the closure, the male member has a male exterior side for connecting to a first end of a garment, a bar with a ball on each end, and a flat front surface between the male exterior side and the bar. The female member has a female exterior side for connecting to a second end of the garment, a trough shaped to receive the bar, and a flat rear surface at least partially surrounding the trough. The bar is positionable in the trough when the male member and the female member are in a substantially transverse orientation. When the bar is positioned in the trough and the male member is rotated so that the male member and the female member are substantially coplanar, the flat front surface of the male member contacts the flat rear surface of the female member and the first and second ends of the garment are connected. The male member further includes two side arms connecting the male exterior side and the bar. The side arms are each angled inward from the male exterior side to a ball of the bar. The length of the bar is shorter than the length of the male exterior side. The trough of the female member includes concave regions to receive each ball of the bar.

In accordance with another embodiment, the female member includes a detent which protrudes from the sidewall of the trough and restricts the width of at least a portion of the trough.

In accordance with another embodiment, wherein at least one of the sidewalls has straight endwalls adjoining both the curved end of the sidewall and the flat rear surface.

In accordance with another embodiment, the detent of the female member is a protrusion on the sidewall of the trough which restricts the width of at least a portion of the trough.

In accordance with another embodiment, the concave region of the trough is surrounded by the flat rear surface where the concave region is not adjacent the female exterior side.

In accordance with another embodiment, the bar of the male member has a central region with a substantially rectangular shape. In accordance with another embodiment, the bar intermediate the balls transitions from a curved shape to a substantially rectangular shape.

In accordance with another embodiment, the male member has a male detent which protrudes toward the male exterior side along at least a portion of the bar.

In accordance with another embodiment, the concave region has an outer portion nearest the female exterior side shaped to closely receive the ball and an inner portion nearest the male exterior side when the male member and female member are connected, the inner portion shaped to receive the ball and accommodate movement of the ball in the direction away from the female exterior side.

In accordance with another embodiment, the bar is positionable in the trough when the male member and the female member are oriented at an angle of between about 75 degrees and about 105 degrees.

In accordance with another embodiment, the bar has a ball located intermediate the two ends and the trough of the female member has sidewalls projecting rearward along a portion of the length of the trough intermediate two of the balls. This embodiment is particularly suited for a larger size of closure, such as those having a length greater than 20 mm.

In accordance with another embodiment, the bar of the male member has two central regions with a substantially rectangular cross-section, the central regions separated by one of the balls.

Other embodiments, in addition to the embodiments enumerated above, will become apparent from the following detailed description, taken in conjunction with the accompanying drawings, which illustrate, by way of example, the principles of the garment closure and method of use.

LIST OF DRAWING REFERENCE NUMERALS

Figure 1:
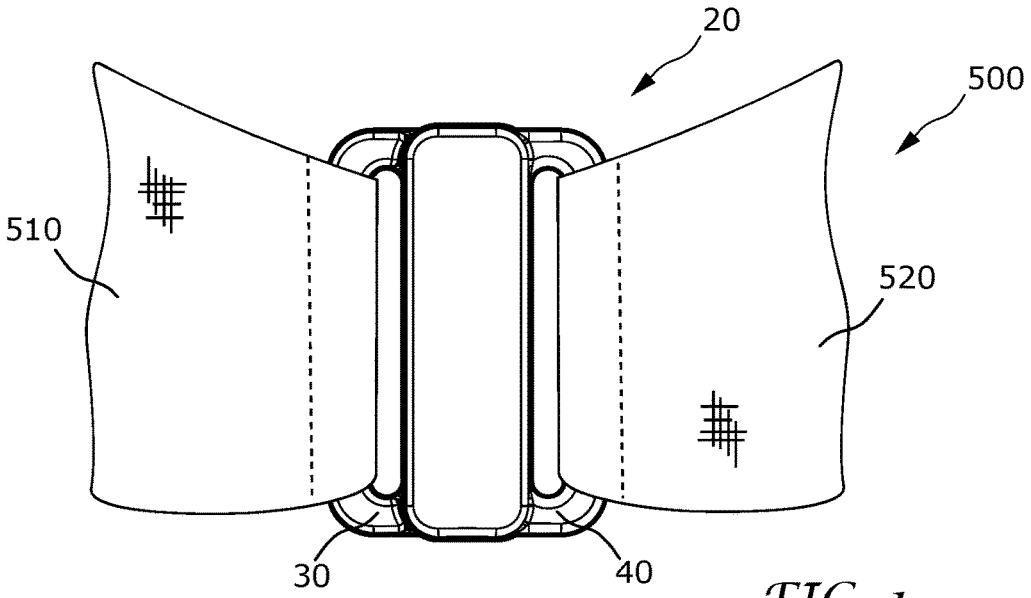
FIG. 1 is a reduced partial front elevation view of a thin garment closure connected to a garment.

20 closure
30 male member
32 bar
33 ball
34 flat front surface
36 male exterior side
37 side arm
38 central region
40 female member
42 trough
43 concave region
44 flat rear surface
46 female exterior side
47 sidewall
48 curved end
49 female front surface
50 detent
52 endwall
54 outer portion
56 inner portion
60 flange
62 alignment bar
63 reinforcement bar
70 recesses
500 garment
510 first end
520 second end

DETAILED DESCRIPTION OF THE INVENTION

Referring initially to FIG. 1, there is illustrated a reduced front elevation view of a thin garment closure 20 in a closed position and connected to a garment 500 (partially shown). Closure 20 includes a male member 30 and a female member 40 (see also FIGS. 4 & 10). Garment 500 has a first end 510 and a second end 520 which are connectable by means of closure 20. Closure 20 is particularly suited for use with garments such as brassieres, lingerie, and swimwear, however its utility is not limited to these applications. In an embodiment, the closure is a front closure for a brassiere, where first and second ends 510 and 520 of garment 500 are to be joined between two brassiere cups. In another embodiment, the closure is a brassiere shoulder strap fastener and first and second garment ends 510 and 520 include one end of a brassiere shoulder strap and one of either material above a brassiere cup or material at the top of a brassiere back strap. In another embodiment, the closure is a back closure for a brassiere, where first and second ends 510 and 520 of garment 500 are two ends of a back strap.

Figure 2:
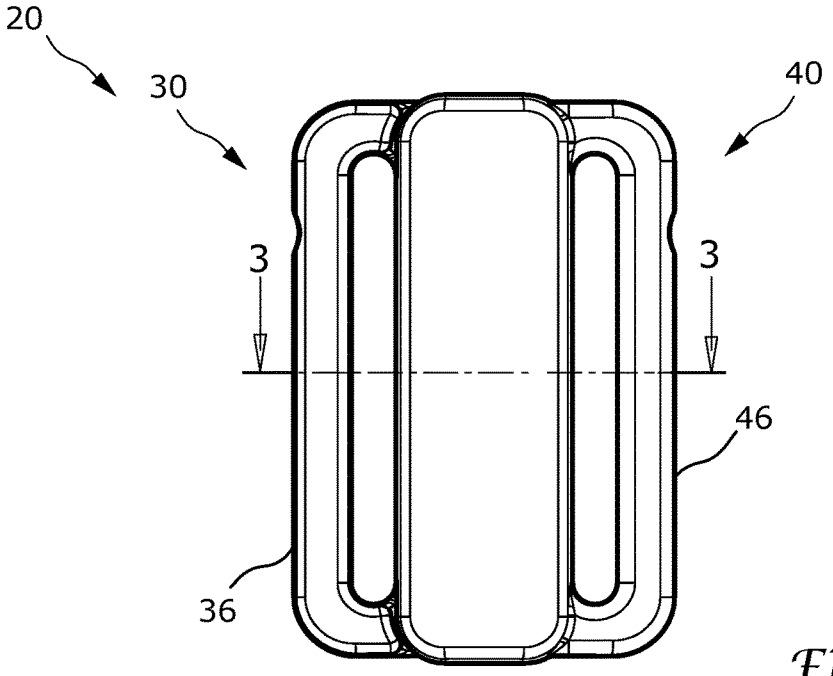
FIG. 2 is a front elevation view of the closure.
Figure 3:
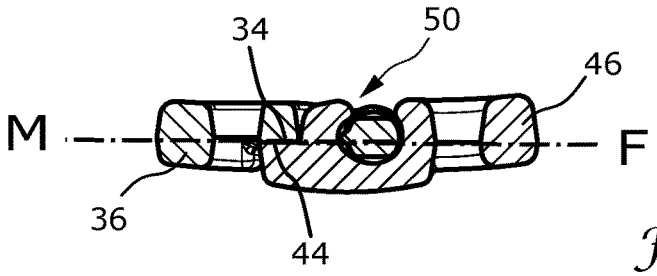
FIG. 3 is a cross-sectional view along the line 3-3 of FIG. 2.
Figure 5:
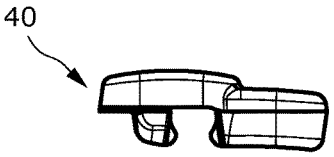
FIG. 5 is a bottom plan view of the female member.

FIG. 2 is a front elevation view of closure 20 and FIG. 3 is a cross-sectional view along the line 3-3 of FIG. 2. Male member 30 and female member 40 have, respectively, male and female exterior sides 36 and 46. First end 510 of garment 500 may be connected to male exterior side 36 and second end 520 may be connected to female exterior side 46 (see also FIG. 1). In the shown embodiment, ends 510 and 520 are connected, respectively, to exterior sides 36 and 46 of closure 20 by feeding the fabric of each garment end through a loop in the corresponding exterior side of a closure member and stitching the fabric of the garment end to itself (as indicated by the dashed lines of FIG. 1). Ends 510 and 520 of garment 500 may be connected to exterior sides 36 and 46 of closure 20 by other methods well known in the art, including simply passing the end through the opening for attachment elsewhere on the garment, as in the case of an adjustable length brassiere shoulder strap.

Figure 4:
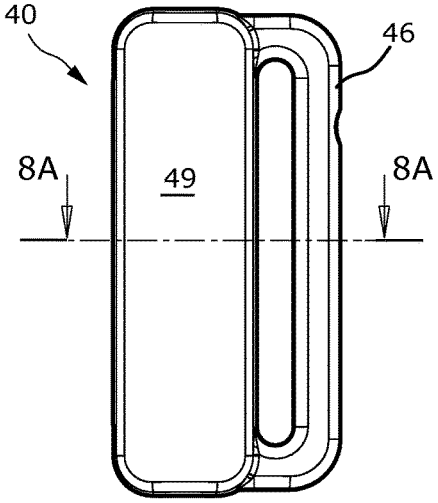
FIG. 4 is a front elevation view of a female member of the closure.
Figure 6:
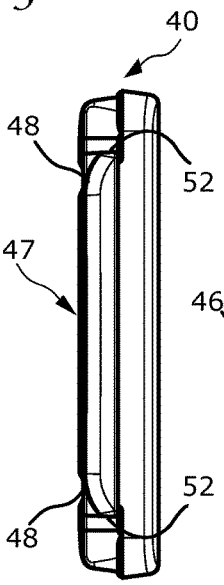
FIG. 6 is a left side elevation view of the female member.
Figure 7:
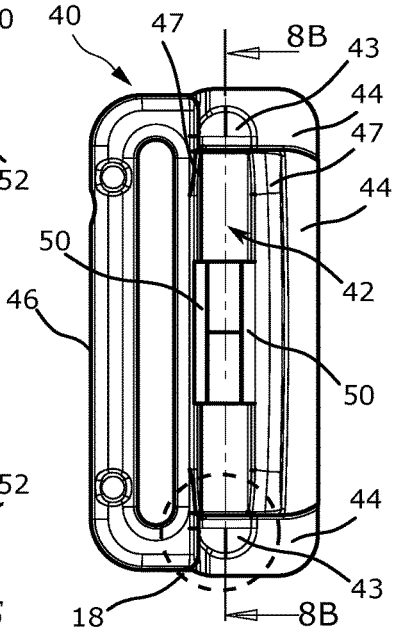
FIG. 7 is a rear elevation view of the female member.
Figure 8A:
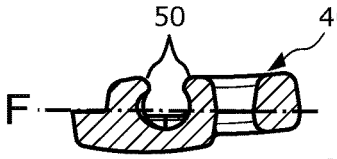
FIG. 8A is a cross-sectional view along the line 8A-8A of FIG. 4.
Figure 8B:
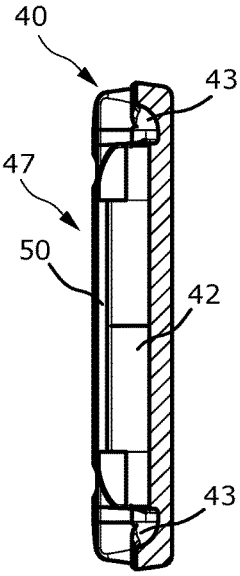
FIG. 8B is a cross-sectional view along the line 8B-8B of FIG. 7.
Figure 11:
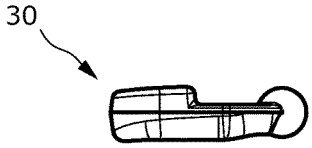
FIG. 11 is a bottom plan view of the male member.

FIGS. 4-7, 8A-8B, and 9A-9B of female member 40 of closure 20 give, respectively, front elevation, bottom plan, left side elevation, rear elevation, cross-sections along lines 8A-8A of FIGS. 4 and 8B-8B of FIG. 7, and front and rear perspective views. Female member 40 is preferably unitarily formed by molding and comprised of a high performance polymer such as polyoxymethylene (POM) or polyamide (PA). Female member 40 generally lies in the plane F shown in FIG. 8A. When a garment including closure 20 is worn, the rear of female member 40 faces the body of the wearer. Female member 40 has a trough 42 in the rear face which is preferably oriented longitudinally and substantially parallel to and offset from female exterior side 46. Trough 42 is shaped to receive a bar 32 of male member 30 (see discussion of FIGS. 10-15). Female member 40 has one or more flat rear surfaces 44 which adjoin and at least partially surround trough 42. Female member 40 has a female front surface 49 which may have various shapes such as rectangular or ovate, and may include various decorations or logos.

Figure 10:
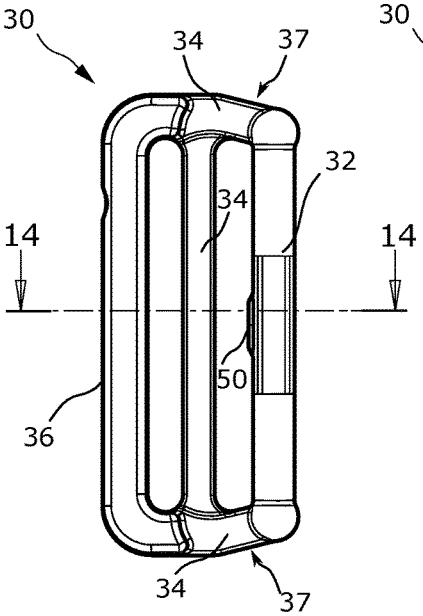
FIG. 10 is a front elevation view of a male member of the closure.
Figure 12:
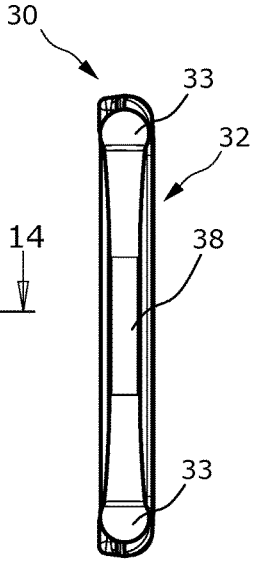
FIG. 12 is a right side elevation view of the male member.

FIGS. 10-15 of male member 30 of closure 20 give, respectively, front elevation, bottom plan, right side elevation, rear elevation, cross-section along lines 14-14 of FIG. 10, and front perspective views. Male member 30 is preferably unitarily formed in the manner and of materials as described above for female member 40. Male member 30 generally lies in the plane M shown in FIG. 14. Male member 30 has a bar 32 which is preferably oriented longitudinally and substantially parallel to and offset from male exterior side 36. Bar 32 is shaped to be received in trough 42 of female member 40. In the shown embodiment, bar 32 has two ends and each end terminates in a ball 33. Ball as used herein means a rounded protuberance. The diameter of ball 33 is preferably greater than the thickness of bar 32, in other words the ends of bar 32 are enlarged. Each ball 33 corresponds to a substantially complimentary shaped concave region 43 on the ends of female trough 42 (see FIGS. 7 & 8B). The rear of male member 30 faces the body of the wearer when worn. Male member 30 has one or more flat front surfaces 34 located between male exterior side 36 and bar 32.

Bar 32 of male member 30 may have various shapes including cylindrical, rectangular, polygonal, or of tapered width. In an embodiment, bar 32 has a central region with a substantially rectangular shape. In another embodiment, shown in FIG. 12, bar 32 transitions from having a curved shape to a substantially rectangular shape, intermediate balls 33. The shape of the bar in this embodiment is configured to resist bending of the male bar.

Figure 13:
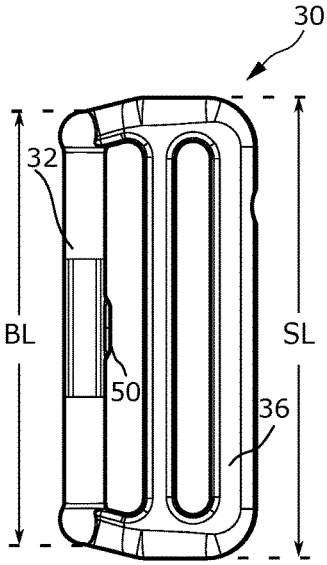
FIG. 13 is a rear elevation view of the male member.

Male member 30 has two side arms 37 which connect male exterior side 36 with bar 32. Side arms 37 are each angled inward toward the center of closure 20 from male exterior side to a ball 33 of bar 32. Bar 32 has a length, BL, and male exterior side 36 has a length, SL (FIG. 13). Length BL of the bar is shorter than length SL of the male exterior side. It is desirable to reduce the length of bar 32 to reduce the effects of bending from the ends of the bar, and thereby increase the tensile strength of the closure.

Figure 14:
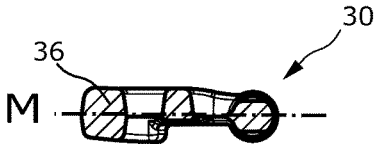
FIG. 14 is a cross-sectional view along the line 14-14 of FIG. 10.
Figure 15:
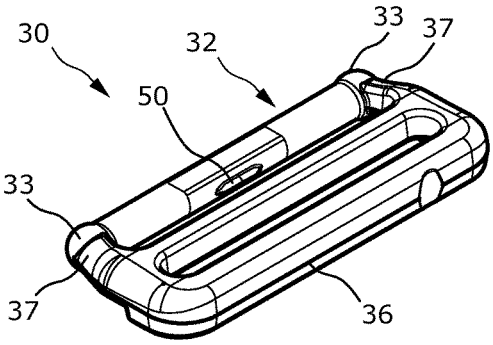
FIG. 15 is a rear perspective view of the male member.
Figure 16A:
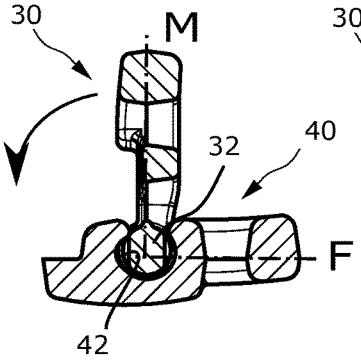
FIGS. 16A-B are enlarged cross-sectional views of the closure in partially closed positions.
Figure 16B:
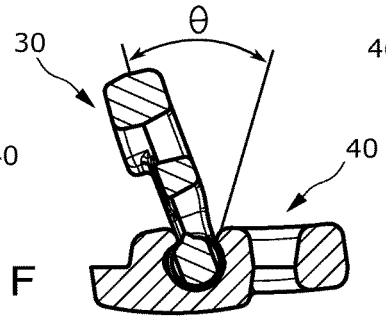

FIGS. 16A and 16B are cross-sectional views of male member 30 and female member 40 in partially coupled states. Cross-sections of members 30 and 40 are as shown in FIGS. 8A and 14. To couple male and female members 30 and 40, the members are oriented such that planes M and F are substantially transverse and bar 32 of the male is aligned with trough 42 of the female. Bar 32 is inserted into trough 42, and one or both of the closure members are rotated until planes M and F are substantially coplanar (see FIG. 3); ends 510 and 520 of garment 500 are thereby connected. When closure 20 is fully closed, flat rear surface 44 of female member 40 contacts flat front surface 34 of male member 30 (FIG. 3). Flat rear surface 44 of female member 40 allows female member 40 to be coupled with male members 30 of various sizes and shapes, as long as trough 42 is shaped to receive bar 32. The contacting flat surfaces 34 and 44 also enable a thin overall closure, with the complete assembly thickness substantially equal to the thickness of either the male or female members alone.

In an embodiment, male member 30 will couple with female member 40 when planes M and F are offset from orthogonal by up to about 15 degrees in either direction. In other words, planes M and F do not need to be oriented at an angle of substantially 90 degrees, but coupling will be possible when planes M and F are oriented between about 75 degrees and about 105 degrees relative to one another. This feature is illustrated by the range of angles marked θ in FIG. 16B. A smaller range of angles is also possible (e.g. +/−10 degrees, +/−5 degrees).

Figure 9B:
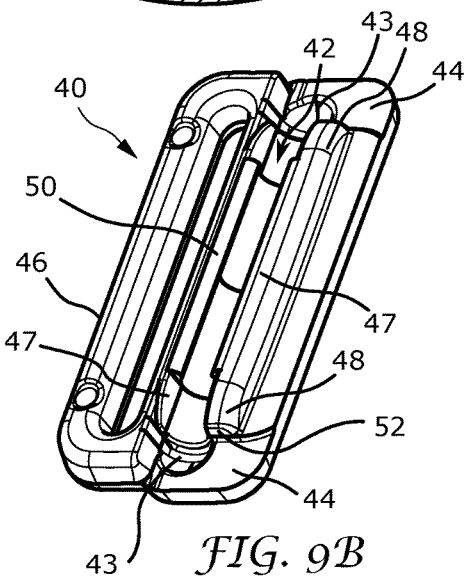
FIG. 9B is a rear perspective view thereof.
Figure 9A:
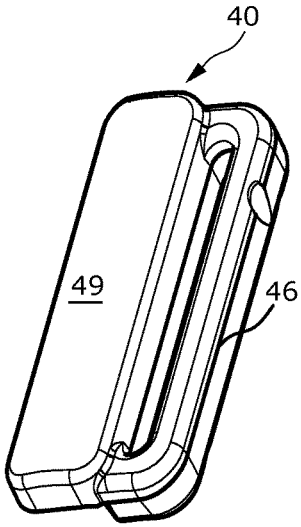
FIG. 9A is a front perspective view of the female member.

In an embodiment, female trough 42 has two longitudinal sidewalls 47 which project rearward past flat rear surface 44 (see FIGS. 6, 7, & 9B). Sidewalls 47 extend along a portion of the length of trough 42, in other words sidewalls 47 do not extend the full length of trough 42 but are somewhat shorter at one or both ends. Sidewalls 47 may extend along a portion of trough 42 intermediate concave regions 43. Sidewalls 47 have tapered or curved ends 48, which curve from the rearmost surface of the sidewall toward flat rear surface 44.

Figure 17A:
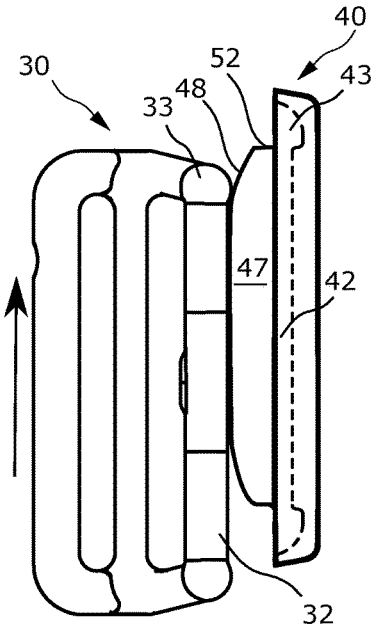
FIGS. 17A-C are side views of the closure in partially coupled positions.
Figure 17B:
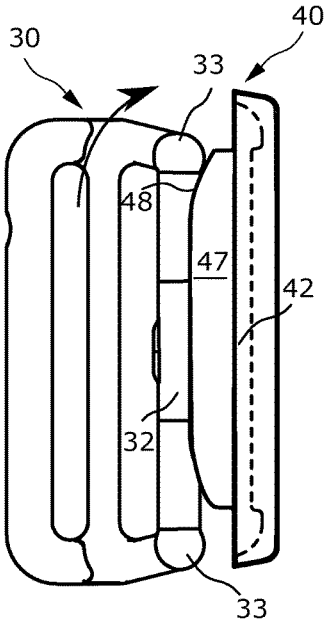
Figure 17C:
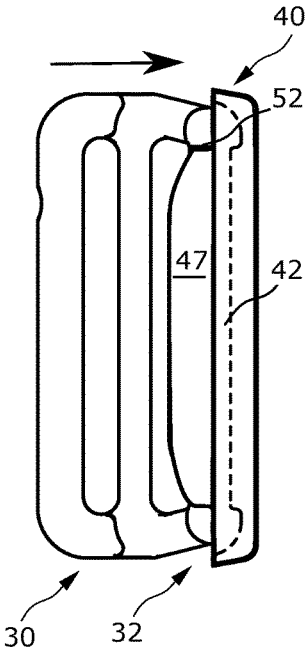
Figure 20:
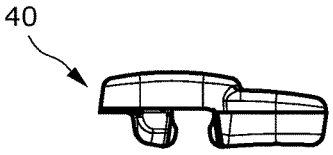
FIG. 20 is a bottom plan view of the FIG. 19 embodiment.
Figure 19:
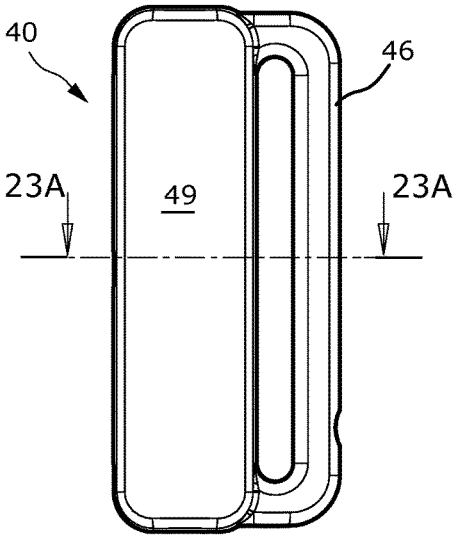
FIG. 19 is a front elevation view of an embodiment of the female member.
Figure 21:
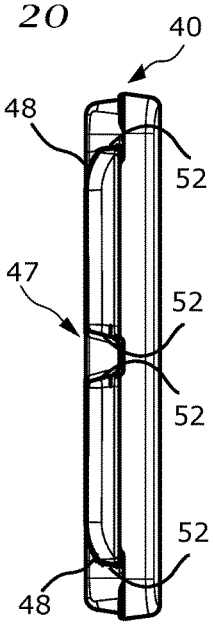
FIG. 21 is a left side elevation view of the FIG. 19 embodiment.

FIGS. 17A-C are side views of the closure in partially coupled positions. Curved end 48 guides ball 33 of bar 32 into concave region 43 of trough 42 (shown in hidden lines) in the event that bar 32 and trough 42 are mis-aligned when being coupled. For example, if bar 32 and trough 42 are longitudinally offset (FIG. 17A), one of the members may be shifted longitudinally relative to the other while bar 32 contacts sidewall 47 until ball 33 meets a curved end 48 of sidewall 47. When the longitudinal shift is continued past this point (FIG. 17B), curved end 48 will guide ball 33 toward trough 42 until bar 32 is positioned in trough 42 and members 30 and 40 are coupled (FIG. 17C). The male member may then be rotated to bring the male and female members into a substantially coplanar orientation, thereby fully closing the closure.

In an embodiment, at least one sidewall 47 has straight endwalls 52 adjoining both curved end 48 and flat rear surface 44 (i.e. in the region of the connection of sidewall 47 to flat rear surface 44). The straight endwalls 52 function to prevent the male member from decoupling in the region of curved end 48 if bar 32 is bent under tension.

Figure 18:
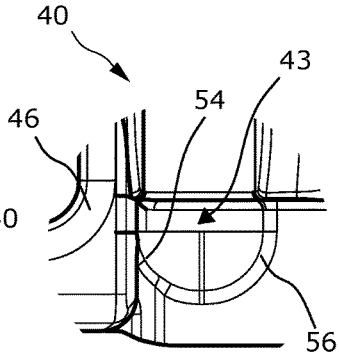
FIG. 18 is an enlarged view of area 18 of FIG. 7.

In an embodiment of female member 40, concave regions 43 of trough 42 are surrounded by flat rear surface 44 in areas where concave region 43 is not adjacent female exterior side 46 (see FIGS. 7 & 9B). FIG. 18 is an enlarged view of area 18 of FIG. 7. Concave region 43 has an outer portion 54 nearest female exterior side 46. Outer portion 54 is shaped to closely receive a ball 33 of the bar 32 of the male member 30 (not shown). Concave region 43 has an inner portion 56 nearest male exterior side 36 when male member 30 and female member 40 are connected. Inner portion 56 is shaped to receive ball 33 and accommodate movement of ball 33 in the direction away from female exterior side 46. In other words, concave region 43 is substantially complementary shaped to ball 33, with an enlargement in the direction of male exterior side 36. This enlargement permits some motion of ball 33 within concave region 43 if bar 32 is bent under tension, and allows male member 30 to bend under tension while remaining coupled within trough 42, thus increasing the resistance of the closure to decoupling.

At least one of closure members 30 and 40 includes detent means, such as located on trough 42 or bar 32, for resiliently retaining the closure members in their coplanar positions when coupled. Examples of a detent 50 which locks the two members in their coplanar positions are shown in FIGS. 3, 7, 8A and 10. Protrusions, for example thin strips, on sidewalls 47 of trough 42 partially overhang the rearmost access to trough 42, restricting the width of at least a portion of trough 42 (see FIGS. 7, 8A, and 9B). A detent 50 on male member 30 (FIG. 10) is for example a bump which protrudes along the width of at least a portion of bar 32. When closure 20 is closed (FIG. 3), male detent 50 is retained under one or more of female detents 50. The detent resists decoupling of closure 20 by twisting or pulling toward or away from the wearer's body. When the closure is decoupled by rotating male member 30, the male detent may be forcibly passed by the resilient female detent. This action may cause an audible click.

Another embodiment of closure 20 is shown in FIGS. 19-30. FIGS. 19-22, 23A-23B, and 24A-24B show, respectively, front elevation, bottom plan, left side elevation, rear elevation, cross-sections along lines 23A of FIGS. 19 and 23B of FIG. 22, and front and rear perspective views of female member 40 of closure 20. FIGS. 25-30 show, respectively, front elevation, bottom plan, right side elevation, rear elevation, cross-sections along lines 29A and 29B of FIG. 28, and front perspective views of male member 30 of closure 20. Parts of the closure are identified using the same reference numerals as in previous figures.

Male member 30 of FIGS. 25-30 includes a ball 33 located intermediate the two ends of bar 32, each of which also terminate in a ball 33. Trough 42 of female member 40 of FIGS. 19-24B has a concave region 43 corresponding to each ball 33 of bar 32. Trough 42 has sidewalls 47 projecting rearward along a portion of the trough intermediate two of the concave regions 43. Sidewalls 47 have curved ends 48 which guide ball 33 into position in trough 42 as described above. At least one sidewall 47 may have straight endwalls 52 adjoining both curved end 48 and flat rear surface 44, to prevent the male member from decoupling if bent under tension. The shown embodiment of closure 20 is particularly suited to larger versions of the closure, for example, where bar 32 of male member 30 is greater than about 20 mm in length. The additional ball 33 and corresponding concave region 43 of the female member 40 serve to reinforce the coupling and increase tensile strength of the closure.

Figure 27:
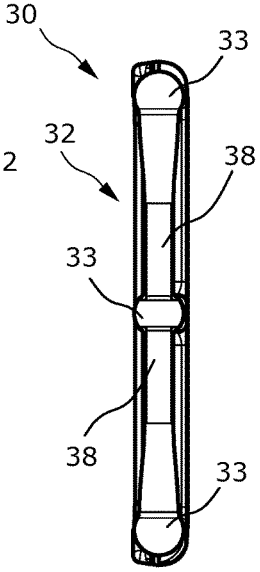
FIG. 27 is a right side elevation view of the FIG. 25 embodiment.
Figure 28:
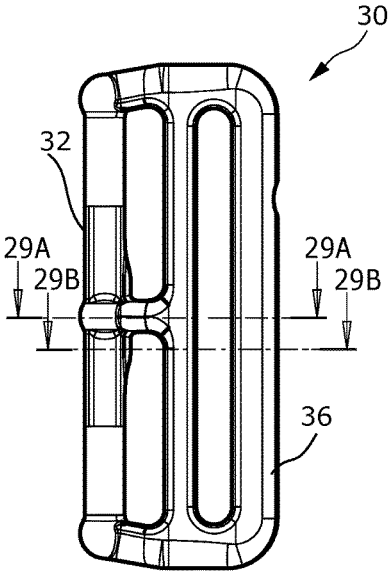
FIG. 28 is a rear elevation view of the FIG. 25 embodiment.
Figure 30:
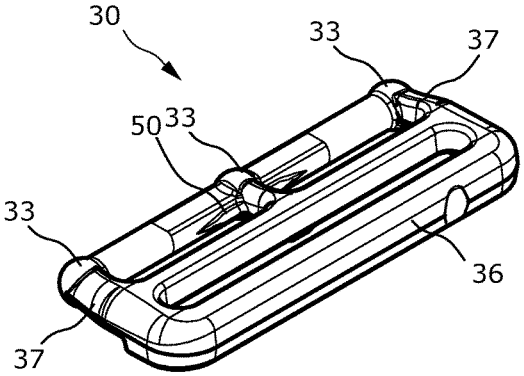
FIG. 30 is a rear perspective view of the FIG. 25 embodiment.
Figure 29A:
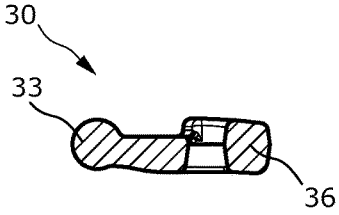
FIG. 29A is a cross-sectional view along the line 29A-29A of FIG. 28.
Figure 29B:
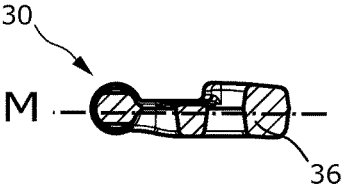
FIG. 29B is a cross-sectional view along the line 29B-29B of FIG. 28.

As best shown in FIG. 27, bar 32 may have two central regions 38 each with a substantially rectangular shape. The two central regions 38 are separated by a ball 33. In another embodiment, bar 32 may transition from having a curved shape to a substantially rectangular shape, intermediate two balls 33. The shape of the bar in this embodiment is configured to resist bending of the male bar.

Figure 22:
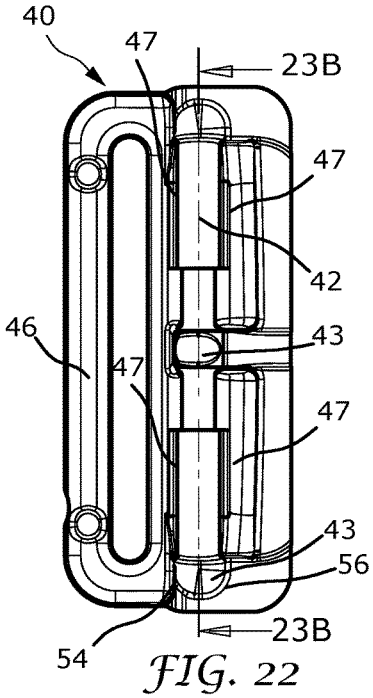
FIG. 22 is a rear elevation view of the FIG. 19 embodiment.
Figure 23A:
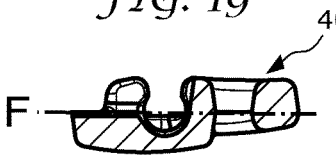
FIG. 23A is a cross-sectional view along the line 23A-23A of FIG. 19.
Figure 24B:
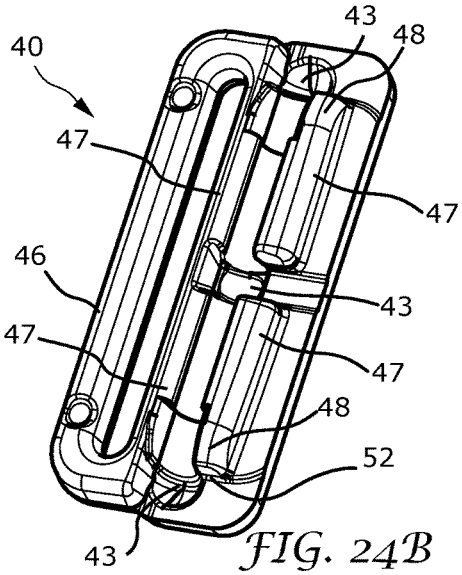
FIG. 24B is a rear perspective view thereof.
Figure 24A:
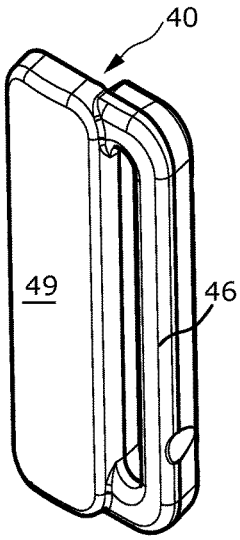
FIG. 24A is a front perspective view of the FIG. 19 embodiment.
Figure 23B:
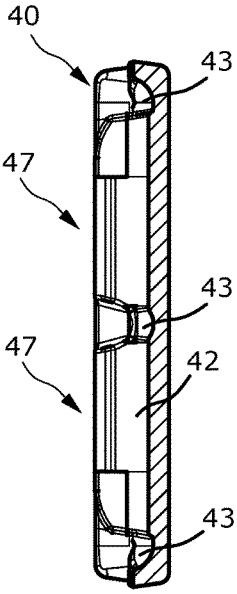
FIG. 23B is a cross-sectional view along the line 23B-23B of FIG. 22.
Figure 26:
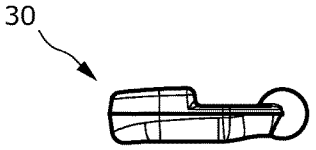
FIG. 26 is a bottom plan view of the FIG. 25 embodiment.
Figure 25:
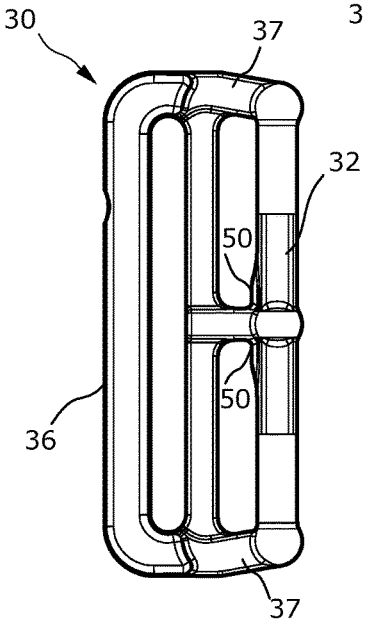
FIG. 25 is a front elevation view of an embodiment of the male member.

Referring to FIG. 22, concave region 43 has an outer portion 54 shaped to closely receive ball 33 and an inner portion 56 shaped to receive ball 33 and accommodate movement of ball 33 in the direction away from female exterior side 46. This configuration allows male member 30 to bend under tension while remaining coupled within trough 42, as described above, and thus increases the resistance of the closure to decoupling.

Further provided is a garment including one or more of the described closure.

The embodiments of the thin garment closure described herein are exemplary and numerous modifications, combinations, variations, and rearrangements can be readily envisioned to achieve an equivalent result, all of which are intended to be embraced within the scope of the appended claims. Further, nothing in the above-provided discussions of the closure and garments including same should be construed as limiting the invention to a particular embodiment or combination of embodiments. The scope of the invention is defined by the appended claims.

We claim:

1. A closure for a garment having a first end and a second end, the closure comprising:

a male member having a male exterior side configured for attachment to the first end of the garment, a bar offset from the male exterior side, the bar having two ends and a ball on each end, and a flat front surface between the male exterior side and the bar;

a female member having a female exterior side configured for attachment to the second end of the garment, a trough shaped to receive the bar and offset from the female exterior side, and a flat rear surface at least partially surrounding the trough;

the bar positionable in the trough when the male member and the female member are in a substantially transverse orientation;

when the bar is positioned in the trough and the male member is rotated so that the male member and the female member are substantially coplanar, the flat front surface of the male member contacts the flat rear surface of the female member and the first and second ends of the garment are connected;

the male member having two side arms connecting the male exterior side and the bar, the side arms each angled inward from the male exterior side to a ball of the bar, the bar and the male exterior side each having a length, and the length of the bar being shorter than the length of the male exterior side; and, the trough of the female member having a concave region to receive each ball of the bar.

2. The closure according to claim 1, further including:

the trough of the female member having sidewalls projecting rearward along a portion of the trough intermediate the concave regions, the sidewalls having curved ends; and, when the bar and the trough are offset longitudinally and the bar is longitudinally shifted while contacting the sidewalls, the curved ends guiding the ball of the bar into position in the trough.

3. The closure according to claim 2, wherein at least one of the sidewalls has straight endwalls adjoining both the curved end and the flat rear surface.

4. The closure according to claim 2, wherein the female member includes a detent which protrudes from the sidewall of the trough and restricts the width of at least a portion of the trough.

5. The closure according to claim 2, wherein the concave region of the trough is surrounded by the flat rear surface where the concave region is not adjacent the female exterior side.

6. The closure according to claim 1, wherein the bar of the male member has a central region with a substantially rectangular shape.

7. The closure according to claim 6, wherein the bar intermediate the balls transitions from a curved shape to a substantially rectangular shape.

8. The closure according to claim 1, wherein the male member has a male detent which protrudes toward the male exterior side along at least a portion of the bar.

9. The closure according to claim 1, wherein the concave region has an outer portion nearest the female exterior side shaped to closely receive the ball and an inner portion nearest the male exterior side when the male member and female member are connected, the inner portion shaped to receive the ball and accommodate movement of the ball in the direction away from the female exterior side.

10. The closure according to claim 1, wherein the bar is positionable in the trough when the male member and the female member are oriented at an angle of between about 75 degrees and about 105 degrees.

11. The closure according to claim 1, further including:

the trough of the female member having sidewalls projecting rearward along a portion of the trough intermediate the concave regions, the sidewalls having curved ends;

when the bar and the trough are offset longitudinally and the bar is longitudinally shifted while contacting the sidewalls, the curved ends guiding the ball of the bar into position in the trough;

at least one of the sidewalls having straight endwalls adjoining both the curved end and the flat rear surface;

the bar intermediate the balls transitioning from a curved shape to a substantially rectangular shape; and, the concave region having an outer portion nearest the female exterior side shaped to closely receive the ball and an inner portion nearest the male exterior side when the male member and female member are connected, the inner portion shaped to receive the ball and accommodate movement of the ball in the direction away from the female exterior side.

12. The closure according to claim 1, further including:

the bar having a ball located intermediate the two ends;

the trough of the female member having sidewalls projecting rearward along a portion of the trough intermediate two of the concave regions, the sidewalls having curved ends;

and, when the bar and the trough are offset longitudinally and the bar is longitudinally shifted while contacting the sidewalls, the curved ends guiding the ball of the bar into position in the trough.

13. The closure according to claim 12, wherein at least one of the sidewalls has straight endwalls adjoining both the curved end and the flat rear surface.

14. The closure according to claim 12, wherein the bar of the male member has two central regions each with a substantially rectangular shape, the central regions separated by one of the balls.

15. The closure according to claim 14, wherein the bar intermediate two of the balls transitions from a curved shape to a substantially rectangular shape.

16. The closure according to claim 12, wherein each concave region has an outer portion nearest the female exterior side shaped to closely receive one of the balls and an inner portion nearest the male exterior side when the male member and female member are connected, the inner portion shaped to receive the ball and accommodate movement of the ball in the direction away from the female exterior side.

17. The closure according to claim 12, further including:

at least one of the sidewalls having straight endwalls adjoining both the curved end and the flat rear surface;

the bar intermediate two of the balls transitioning from a curved shape to a substantially rectangular shape; and, each concave region having an outer portion nearest the female exterior side shaped to closely receive one of the balls and an inner portion nearest the male exterior side when the male member and female member are connected, the inner portion shaped to receive the ball and accommodate movement of the ball in the direction away from the female exterior side.

18. A garment including the closure of claim 12.

19. A garment including the closure of claim 1.

* * * * *